United States Patent [19]

Paulin et al.

[11] 4,248,952

[45] Feb. 3, 1981

[54] TECHNIQUE FOR MAKING ELECTRICAL GROUND CONTACT WITH THE INTERMEDIATE CONDUCTIVE LAYER OF AN ELECTROSTATOGRAPHIC RECORDING MEMBER

[75] Inventors: John M. Paulin, South Hadley Falls; Richard W. Fournier, Holyoke, both of Mass.

[73] Assignee: James River Graphics Inc., South Hadley, Mass.

[21] Appl. No.: 898,579

[22] Filed: Feb. 14, 1978

Related U.S. Application Data

[63] Continuation of Ser. No. 770,046, Feb. 18, 1977, abandoned, which is a continuation of Ser. No. 667,081, Mar. 15, 1976, abandoned, which is a continuation of Ser. No. 434,398, Jan. 18, 1974, abandoned.

[51] Int. Cl.[3] ..... G03G 5/04

[52] U.S. Cl. ..... 430/62; 430/127; 430/130

[58] Field of Search ..... 96/1.5, 1 R; 174/68.5; 427/88, 123; 428/368; 430/62, 127, 130

[56] References Cited

U.S. PATENT DOCUMENTS

| | | | |
|---|---|---|---|
| 2,277,013 | 3/1942 | Carlson | 96/1 R |
| 3,118,789 | 1/1964 | Wiswell et al. | 96/1.5 |
| 3,141,770 | 7/1964 | Davis | 96/1 R |
| 3,601,523 | 6/1971 | Arndt | 174/68.5 |
| 3,684,503 | 8/1972 | Humphriss et al. | 96/1.5 |
| 3,751,292 | 8/1973 | Kongable | 427/123 |
| 3,779,749 | 12/1973 | Sato | 96/1 R |

OTHER PUBLICATIONS

IBM Technical Disclosure Bulletin, Green, vol. 3, No. 12, May 1961.

Chemical Technology: An Encyclopedic Treatment van Oss, ©1970, McGraw-Hill vol. III, pp. 749-755.

Handbook of Thin Film Technology-Maissel et al., pp. 6-2 to 6-7, McGraw-Hill, New York., N.Y. 1970.

*Primary Examiner*—J. Travis Brown

*Attorney, Agent, or Firm*—Burns, Doane, Swecker & Mathis

[57] ABSTRACT

In an electrostatographic recording member comprising at least:

an electrically-insulating substrate;

an intermediate layer overlying the substrate, the intermediate layer being electrically conductive;

an outer layer overlying the intermediate layer, the outer layer comprising a photoconductive material or a dielectric material of high volume resistivity; and means for establishing a ground connection to the electrically-conductive intermediate layer;

the improvement comprising said ground connection means comprising at least one hole or aperture disposed through the thickness of the recording member from a surface thereof at least to the depth of the conductive intermediate layer and substantially completely filled with an electrically-conductive composition comprising a plastic adhesive and a sufficient amount of an electrically-conducting pigment to make the composition electrically-conductive. The aperture or hole may extend through the entire thickness of the recording member and is located in a non-image area thereof.

13 Claims, 6 Drawing Figures

TECHNIQUE FOR MAKING ELECTRICAL GROUND CONTACT WITH THE INTERMEDIATE CONDUCTIVE LAYER OF AN ELECTROSTATOGRAPHIC RECORDING MEMBER

This is a continuation, of application Ser. No. 770,046, filed 2/18/77, abandoned, which is a continuation of Ser. No. 667,081 filed 3/15/76, abandoned, which is a continuation of Ser. No. 434,398 filed 1/18/74, abandoned.

BACKGROUND OF THE INVENTION

1. Field of the Invention

The present invention relates generally to electrophotographic and electrostatic recording elements and processes for making the same; and more particularly to an improved technique for making an electrical ground connection to the intermediate electrically-conductive layer of such elements.

2. Description of the Prior Art

As used in the present specification, the term "electrostatographic" is intended to mean and cover both electrographic and electrophotographic members.

Both types of recording elements are employed in reproduction processes. Essentially, a latent image is formed in these elements by providing an imagewise surface charge on an insulating surface of the element, and thereafter developing the charged latent image by means of an electrically-attractable material, such as a "toner" (i.e., directionally charged colloid carbon particles suspended in an insulating liquid or on a dry carrier).

Specifically, an electrophotographic element normally comprises at least a substrate having coated thereon a layer containing a suitable photoconductor. The support layer is made conductive either by the inclusion therein of electrically-conductive materials or by coating its surface (the surface designed to receive the photoconductive layer) with an electrically-conductive material. Images are usually formed on the photoconductive layer by first applying a uniform electrostatic charge to the photoconductive layer by any suitable method, thereafter imaging the charged material by exposing it to light through a transparent master or by reflection from an opaque master which is being reproduced, thereby causing the photoconductive layer to become conductive, resulting in the dissipation of the charge in those areas of the layer exposed to light. In a subsequent step, the charge pattern or latent image on the image layer is rendered visible by the application thereto of a colored or black electroscopic toner.

An electrographic recording element is similar in construction to the electrophotographic element, with the photoconductive layer being replaced with a high dielectric layer or a "charge retentive layer", that is, a material having a volume resistivity of not less than about $10^{12}$ ohm-centimeters. During this "printing" process the electrical charge is applied to the image areas by a stylus and developed in the same manner as the electrophotographic element.

With either type of element, it is often desirable during one or more of the processing steps (e.g. during charging or during toning) to establish a ground connection (to a reference potential) to the conductive layer of the recording element in order to create a highly conducting reference plane which is held at or near ground potential. For example, during the electrostatic charging of the photoconductive layer or during the "printing" of the dielectric layer, the potential of the conducting layer has a tendency to build-up with respect to ground if it is not grounded. If this should occur, then there is a less than desirable difference in potential between the areas struck by light and those not struck in an electrophotographic element, and between the areas retaining or not retaining "print" charges in an electrographic element, resulting in a latent image which is difficult to develop in the subsequent toning step,thereby resulting in copies which exhibit poor image quality, high background discoloration and/or poor contrast.

The prior art is replete with suggestions as to how to assure proper electrical grounding of the conductive layer in such elements. The classical approach is to provide an electrically-conductive substrate which is easy and conventional if the substrate is a permeable or non-homogeneous substrate such as paper, since the substrate can be filled during manufacture with an electrically-conductive pigment such as carbon black, or saturated with a solution of an ionic, hygroscopic substance, such as salt of a polyelectrolyte. However, there are disadvantages in such a technique. For example, the ionic hygroscopic impregnant is not generally effective in low porosity papers and the conductivity it imparts is not stable but varies by several orders of magnitude with the relative humidity of the environment. The use of carbon black as a filler insures the stability of the conductivity, but may be unacceptable for aesthetic reasons especially if a white substrate is desired. Moreover, it tends to weaken the substrate physically. Finally, it must be formulated into the substrate at the time of manufacture and thus, cannot be applied to separately-made substrates. In addition, the primary disadvantage of this technique is that it cannot be applied to homogeneous, impermeable substrates, such as extruded or cast films made from, for example, synthetic resins such as polyesters.

A further approach has been to provide a conductive intermediate layer between a non-conducting substrate and the photoconductive or dielectric layer. It has been suggested to contact this conductive intermediate layer by removing the dielectric or photoconductive layer from a limited area thereby exposing the intermediate conductive layer so that an electrode can be physically contacted with the conductive layer. Other approaches have been to cut, punch, scratch or otherwise disrupt the physical integrity of the dielectric or photoconductive layer with an electrode which is forced into contact with the intermediate conductive layer.

A further alternative of the prior art has been to provide a conductive pathway established from the conductive layer to the outer surface of the member where an electrode can establish contact with it. Since it is a part of the recording member, it must be inexpensive to apply, inconspicuous, flexible (in flexible recording elements) and of course both effective and reliable.

An example of the prior art's solutions to this problem is shown in U.S. Pat. No. 3,118,789, Wiswell et al. The patent discloses an electrophotographic recording member comprising a paper substrate, a conductive interlayer and a photoconductive layer overlying the conductive interlayer with, optionally, a conductive layer coating the back side of the paper substrate. The paper substrate is perforated with fine holes so that the conductive lacquer of which the conductive interlayer is composed will penetrate through the paper during the coating operation and thus enable the establishment of an electrical connection therethrough to the conductive interlayer. A disadvantage with this type of electrical connection is that it is not useful with impermeable substrates such as polyester films. If the substrate is a film, and transparency and use as a photographic member is required, the methods suggested in the Wiswell et al patent cannot be employed to establish contact with the conductive interlayer because of the damage such a technique will cause to the film's optical characteristics.

Another solution to the problem is disclosed in U.S. Pat. No. 3,639,121, York. The patentee discloses electrophotographic elements comprising a support, an intermediate conducting layer and an uppermost photoconductive layer wherein electrical contact to the conducting layer is accomplished by coating the edge of the laminate with a conducting lacquer, which coating can be connected to ground to thereby electrically ground the intermediate conducting layer.

U.S. Pat. No. 3,533,692, Blanchette et al, discloses a photoconductive medium wherein the photoconductive layer is removed from an area to expose the conductive interlayer, with which contact is then made with an electrode, or in which a conductive metal strap or rivet is used to establish an electrical connection between the interlayer and a conductive area coated on the back of the laminate.

U.S. Pat. No. 3,552,957, Hodges, discloses the use of mechanical devices such as straps, clamps and rivets applied to an exposed area of the conductive interlayer of an electrophotographic recording member to establish electrical connection with the interlayer.

Similarly, U.S. Pat. No. 3,574,615, Morse, discloses a connection scheme as in Hodges except that an electrically-conductive elastomeric pad is inserted between the clamp-electrode and the exposed surface of the conductive interlayer.

Further, U.S. Pat. No. 3,543,023, Milin et al, eliminates the necessity for stripping the dielectric or photoconductive layer away to expose the conductive interlayer, and discloses instead the use of a corona discharge at the edge of the member to establish the necessary electrical connection.

A disclosure related to the above discussed York patent appears in U.S. Pat. No. 3,684,503, Humphriss et al. Humphriss et al achieves the necessary electrical connection by providing, in a non-recording section of the element, a solid dispersion of a particulate electrically conducting material which extends from an external surface of the element through a portion of at least one of the layers overlying the conductive layer to electrically contact the conducting layer. Alternatively, the dispersion can extend into the element from an edge thereof.

Although the prior art recording members generally function as intended, there has been a need for a technique of providing the necessary electrical ground connection to the conductive interlayer in an electrostatographic recording member which is simple to fabricate and yet is effective in establishing good electrical connection with the conductive interlayer.

SUMMARY OF THE INVENTION

It is therefore a primary object of the present invention to provide an improved technique for making an effective electrical ground connection with the electrically-conducting intermediate layer of an electrostatographic recording element.

It is a further object of the present invention to provide such a connection in an electrophotographic recording member.

It is a further object of the present invention to provide such a connection in an electrograhic recording member.

It is a further object of the present invention to provide a process for producing such an improved electrical ground connection.

Essentially stated, the present invention accomplishes the above objects by providing at least one hole or aperture disposed through the entire thickness (or only partially therethrough) of the recording member in a non-image area thereof, which hole or aperture is substantially completely filled with an electrically-conductive composition comprising a plastic adhesive and a sufficient amount of an electrically-conducting pigment dispersed therein to make the composition electrically-conductive. In a preferred embodiment, a piece of metallic foil is employed to cover the exposed adhesive composition in the hole or aperture which has the effect of reducing the contact resistance between the exterior electrode and the electrically-conductive plastic material in the hole or aperture and further improves the performance and reliability of the technique of the present invention.

The present invention also embodies a process for producing such an electrical connection. The process generally comprises first cutting or piercing a hole in the recording member in a non-image area thereof at least through the dielectric or photoconductive layer to the conductive layer, and then filling the hole with the electrically conductive flexible adhesive composition. The adhesive composition is then bonded to the inner surface of the hole to establish both a mechanical bond therewith and an electrical connection with the intermediate conductive layer. If a hot melt adhesive is employed, heat and pressure are briefly and locally applied to fuse the adhesive and establish a bond with the inside of the hole. If a pressure-sensitive adhesive is employed, only pressure need be applied and in this case it is preferred to apply the coated foil over the exposed adhesive in the hole in order to completely cover and protect the adhesive.

Other objects and advantages will be apparent to those skilled in the art from a consideration of the description of the preferred embodiments which follow hereinbelow, when taken in conjunction with the accompanying drawings.

DESCRIPTION OF THE PREFERRED EMBODIMENTS

Figure 1:
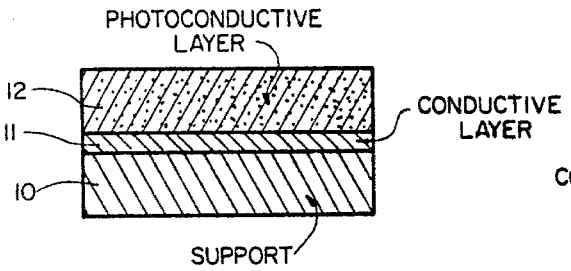
FIGS. 1 and 2 schematically show, in cross-section, alternative embodiments of conventional electrophotographic recording members.
Figure 2:
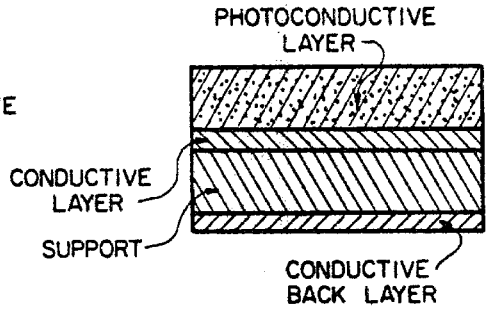

As pointed out above, the present invention is applicable equally to electrophotographic recording members as well as electrographic recording members. Examples of the former are shown in FIGS. 1 and 2 of the drawings. Referring to FIG. 1, a support layer 10 is coated with a conductive layer 11 which in turn is coated with a photoconductive layer 12. The support is normally electrically insulating and may comprise any of the well-known materials used for such purposes. Any conventional conductive pigment may be employed to render layer 11 electrically conductive. Similarly, any conventional photoconductive material may be incorporated into layer 12 to render the same photoconductive, and any conventional binder can be employed in photoconductive layer 12 and conductive layer 11.

To assure good adhesion between the conductive layer and the support, if the two materials employed are not capable of good adhesion to one another, a bonding layer or subbing may be interposed between conductive layer 11 and support 10, as is conventional in the art.

FIG. 2 shows an alternative embodiment wherein on the back side of support 10 is disposed a conductive back layer 13. The latter layer functions as the grounding layer for the element and replaces an exterior electrode which is used with the recording member shown in FIG. 1.

Electrographic recording members are similar in structure to the electrophotographic recording members shown in FIGS. 1 and 2. In essence, the photoconductive layer 12 of the electrophotographic recording member is replaced with a dielectric layer having a high volume resistivity, normally a minimum of $10^{12}$ ohm-centimeters. Any conventional dielectric material can be employed as is obvious to those skilled in the art.

With either the electrographic or the electrophotographic recording members, it is important to electrically connect the conductive layer 11 to ground during the charging and development of the uppermost layer. If the conductive layer is not electrically grounded, the difference in potential between the upper layer and the conductive layer diminishes as a result of build-up of charge in the conductive layer. The more equal charge diminishes the quality and clarity of the image since the imaged areas in the upper layer have less of a tendency to selectively attract the developing material, as compared to the non-imaged areas, due to the small difference in potential between the upper layer and the conductive layer. If the conductive layer is properly grounded, the difference is potential is significant and therefore the imaged areas are easily capable of attracting the electrically-directed developing material, the toner, thereby producing a clear image.

The improved electrical ground connection of the present invention possesses numerous advantages over the prior art. Essentially, electrical ground connection to the electrically-conductive intermediate layer in the recording member is made by first punching or otherwise cutting a hole in a non-image area of the recording member and filling the hole with and bonding thereto an electrically-conducting plastic adhesive thereby establishing both a mechanical bond with the walls defined by the hole and an electrical contact with the exposed conductive intermediate layer therein. The plastic adhesive composition may or may not contain a solvent for the plastic material, the adhesive without the solvent being preferred in order to eliminate the need for drying the adhesive and to avoid possible shrinkage problems associated with the loss of solvents from the adhesive composition as the composition dries. Further, any known adhesive composition can be employed in the practice of the present invention without limitation.

In a preferred embodiment, a metallic foil coated with the adhesive composition of the present invention can be applied to both sides of the recording member over the hole (if the hole extends through the entire thickness) and the adhesive coating may be forced into the hole from both sides to form the electrical connection of the present invention.

Alternatively, instead of punching or cutting a hole through the recording member, the photoconductive or dielectric coating may be selectively removed from a certain area such as by using a solvent, or by scoring, scratching or otherwise destroying the physical integrity of the coating, to expose the underlying conducting intermediate layer. The adhesive compositions of the present invention can then be inserted into the resulting channel, which extends at least to the conductive intermediate layer. This embodiment may also be utilized with the adhesive-coated metallic foil.

To be more specific, the first step in the process for forming the improved electrical connection of the present invention is to cleanly punch or otherwise cut a hole in the recording member is not critical as long as it is in a non-image area thereof. Preferably, the hole should be cleanly sheared or punched entering from the side of the member on which the photoconductive or dielectric layer is coated. The hole should be punched as neatly as possible in order to preserve the integrity and continuity of the electrically-conductive intermediate layer around the edge of the hole.

The adhesive that is used to fill the hole can be any conventional plastic adhesive known to those skilled in the art. The adhesive is made electrically conductive by mixing therein an electrically conducting pigment such as carbon black; graphite; acetylene black; metal powders such as nickel, silver, etc.; conductive zinc oxide, powdered semi-conductor material; and the like. Generally, the pigment employed is not critical as long as it is electrically conductive so as to provide the adhesive with a sufficient conductivity to prevent build-up of potential in the conductive layer. Normally, the adhesive has a maximum resistance value of about $10^8$ to $10^{16}$ ohms cm. The resistance of the conductive adhesive should be less than $10^{11}$ ohm cm., and it can be varied by changes in the formulation. The total resistance of the entire insert should not be greater than $10^9$ ohms.

Any suitable mixing technique can be employed to disperse the conductive pigment through the adhesive. As an example, a ball milling technique can be employed to uniformly disperse the conductive pigment through the adhesive composition.

The adhesive employed (in the embodiment which requires a solvent) is not limited and includes any known adhesive composition which is compatible with the recording members of the invention, is capable of being made conductive by the inclusion therein of a conductive pigment and is capable of being applied from a solvent solution or dispersion.

Typical solvent-free adhesive formulations include those adhesives which are known to those skilled in the art and include without limitation hot-melt adhesives and pressure-sensitive adhesives. A typical example of the former is as follows, the parts being parts by weight:

| Hot Melt Adhesive | |
|---|---|
| Component | Parts |
| Kraton 1101 | 10.00 |
| Shawinigan Black Acetylene | 2.00 |
| Plastanox 2246 | 0.05 |
| Plastanox LTDP | 0.05 |
| Toluene | 55.00 |
| Methyl Ethyl Ketone | 32.90 |
| | 100.00 |

To obtain a solvent-free, hot-melt adhesive, the formulation of the example is coated on an aluminum foil and the solvent is removed in a drying oven. The film thickness of the resulting hot-melt coating is kept in the neighborhood of ½ to ⅓ the thickness of the electrophotographic or electrographic member to which the coated foil is to be supplied by heat and/or pressure. The thickness of the coating may be adjusted to the desirability of the amount of "flash", i.e., the flow of the hot-melt surrounding the aluminum foil used as a covering material in such a laminate.

The Kraton 1101 is a styrene-butadiene copolymer and is available from the Shell Chemical Company. The Shawinigan Black Acetylene is available from the Monsanto Chemical Company, and comprises essentially acetylene black. Both Plastanox components are available from American Cyanamid and are anti-oxidants used to prevent embrittlement of the resins in which they are employed. Plastanox LTDP is dilaurylthiodipropionate and Plastanox 2246 is 2,2'-methylenebis-(4-methyl-6-tertiarybutylphenol). The surface resistance of the above hot-melt adhesive is $8.0\times10^2$ ohms per square centimeter. The relationship between surface resistance and resistivity is disclosed in columns 2 and 3 of York U.S. Pat. No. 3,639,121, and the surface resistance given herein may be determined by the method described in said patent.

A typical example of a pressure-sensitive adhesive is as follows:

| Pressure-Sensitive Adhesive | |
|---|---|
| Component | Parts |
| Monsanto RA 1151 | 23.0 |
| Shawinigan Black Acetylene | 2.0 |
| Ethyl Acetate | 40.0 |
| Toluene | 35.0 |
| | 100.0 |

The Monsanto RA 1151 is a resin available from the Monsanto Chemical Company and comprises about 35% solids, with the balance being a solvent comprising ethylacetate (55%) and toluene (45%). The surface resistance of the pressure-sensitive adhesive described above is $2.0\times10^2$ ohms per square centimeter.

Suitable hot-melts that are conductivized by pigments dispersed in solvents and coated on the foil and dried may be chosen from the following:

Solid fatty polyamides, poly(vinyl acetate) - rosin, ethylene - vinyl acetate copolymer, petroleum wax, laminating-grade microcrystalline wax, rosin or ester gum, vinyl acetate-crotonic acid, beta-pinene polymer, polyvinylacetate, polyethylene, paraffin wax, dimerized rosin, modified rosin or rosin ester, ethyl cellulose, ester wax, paraffin mineral wax, polyterpene, polyterpene urethane, B-pinene resins, terpene wax - polyethylene covinyl-acetate (Elvax 260 DuPont), and the like.

If the adhesive composition is applied using a solvent, after the adhesive composition solution is inserted into the hole in the recording member, it is then dried to establish a firm mechanical bond with the inside of the hole and also to establish the electrical contact with the exposed conductive layer on the inner surface of the hole. The hot-melt type of solvent-free adhesive is simply heated to melt the same and it can be easily flowed into the hole. It is not necessary to heat the pressure-sensitive adhesive since the application of pressure alone is sufficient to assure that the adhesive completely fills the hole in the recording member.

The particle size of the conductive pigment is not at all critical, and any conventionally-sized conductive pigment can be employed. Generally, the particle size of the conductive pigment will vary depending upon the particular material used and generally ranges from 5 to 200 millimicrons, although it is not intended to limit the particle size of the conductive pigment used in the present invention to this range. Those skilled in the art can determine the optimum particle size depending upon the desired surface resistance, the thickness of the adhesive, the amount of pigment contained in the adhesive, and various other considerations.

The amount of the conductive pigment that is present in the adhesive varies from the minimum amount necessary to make the adhesive conductive to a maximum amount which is limited only by the ability of the adhesive to retain the pigment dispersed or mixed therein. Generally, the amount of conductive pigment will vary from a minimum of 0.5 parts by weight to a maximum of 15 parts by weight, based on the weight of the adhesive composition. A mixture of conductive pigments may also be employed depending upon the end use.

The solvent-free adhesives are preferred in the practice of the present invention since the need for drying is eliminated and the shrinkage problems associated with the loss of solvents or possible solvent retention therein in the event of incomplete drying, are avoided. The plasticity necessary for a solvent-free adhesive may be obtained either by melting the adhesives at the time of application (in the case of a hot-melt adhesive) or by formulating it with various polymeric materials, tackifying agents, etc. and applying it as a pressure-sensitive adhesive. Since these other ingredients are not part of the present invention per se, and since those skilled in the art can readily prepare such compositions, they will not be described in detail here for purposes of brevity.

Figure 3:
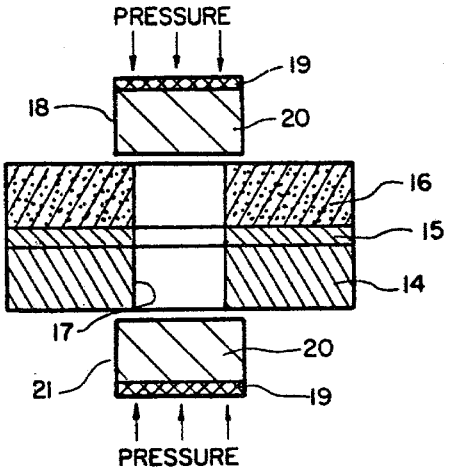
FIG. 3 schematically illustrates a process for providing the improved electrical ground connection of the present invention.
Figure 4:
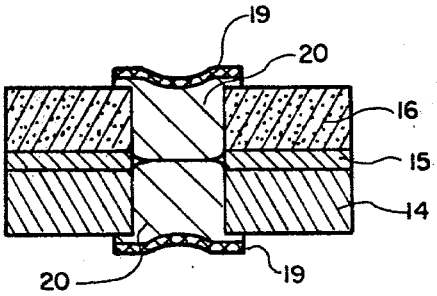
FIG. 4 schematically illustrates an electrophotographic recording member provided with the improved electrical connecting means of the present invention.

In a preferred embodiment, an adhesive coated metallic foil is employed to fill the hole in the recording member. Reference is made to FIGS. 3 and 4 which show this preferred embodiment. FIG. 3 shows a recording member comprising a substrate or support 14, an intermediate conductive layer 15 and an uppermost photoconductive layer 16, or dielectric layer. A hole 17 is provided in a non-image area of the recording member, thereby exposing the intermediate conductive layer 15 on the inner surface of the hole. As shown in FIG. 3, two pieces of adhesive-coated metallic foils 18 and 21, generally, are disposed on opposite ends of the hole. The adhesive-coated metallic foil generally comprises a thin metallic foil 19 having a coating 20 thereon of the adhesive. The metallic foil can be any conducting metallic foil, such as aluminum, copper, tin, etc., and the thickness of the adhesive can be regulated to provide a complete filling of the hole. The adhesive-coated foil pieces are inserted into the hole such as by the use of pressure as indicated in FIG. 3. If a hot-melt adhesive is employed, the only pressure necessary is that sufficient to push the heated adhesive material of the upper and lower pieces of adhesive-coated foils into the hole for contact and fusion. FIG. 4 shows the finished product after the adhesive-coated foil pieces are inserted into the hole punched in the recording member. The advantage of using the adhesive-coated foil pieces is that the contact resistance between the exterior electrode and the conductive adhesive is reduced thereby providing improved performance and reliability. It is further possible to easily extend the conductive area from the hole over the surface of the recording member to whatever contact area and shape is required. Moreover, the metallic foil is more durable and in particular more resistant to abrasion than the exposed conductive adhesive, and in the case of the pressure-sensitive adhesive, it covers and protects the tacky surface from dirt and prevents its inadvertent adhesion or blocking to other surfaces.

Although FIGS. 3 and 4 show the use of two adhesive-coated foil pieces, the invention is equally as applicable to the use of only a single piece applied from only one side of the recording member. The adhesive-coated foil can be conveniently made by precoating one side of the metallic foil with the adhesive composition, for example, from a solvent solution of the same. After drying, the coated foil may be heated or slit and wound up to the desired size. In the case of the pressure-sensitive adhesive, it will usually be necessary to protect the exposed surface of the adhesive such as by the use of the adhesive-coated metallic foil. The use of the adhesive-coated foil provides the additional advantage that the precoated foil can be employed to apply a metered amount of the required adhesive to the hole in the recording member.

The use of two adhesive-coated foil pieces is preferred since not only will a bond be established with the inside of the hole and with the adjoining surface areas underlying both pieces of foil, but the adhesive surfaces will meet in the hole and bond both pieces of foil firmly to each other, which substantially strengthens the electrical connection. A further advantage of using two adhesive-coated foil pieces is evident with electrostatographic recording members which have a conductive back layer as illustrated in FIG. 2. It is functionally important to provide electrical connection between the intermediate conductive layer 11 (referring now to FIG. 2) and the conductive back layer 13. The use of the technique shown in FIGS. 3 and 4 is very effective for accomplishing this purpose. The adhesive-coated foil which is applied simultaneously to the back of the member with the application of the adhesive-coated foil to the front of the member simultaneously establishes contact with the interlayer and with the conductive back layer surrounding the punched hole.

Figure 5:
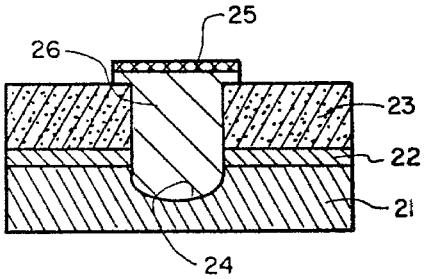
FIGS. 5 and 6 show alternative embodiments of the improved electrical connecting means of the present invention.
Figure 6:
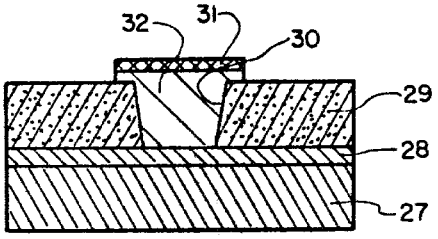

Alternative embodiments of the improved electrical connection technique of the present invention are shown in FIGS. 5 and 6. FIG. 5 shows a recording member comprising a support 21, an intermediate layer 22 which is conductive and an uppermost layer 23 which comprises either a photoconductive material or a high dielectric material. A "slot" or "hole" 24 can be provided through the uppermost layer 23 and intermediate layer 22 of the recording member as shown in FIG. 5. This can be done by any suitable technique, such as by scoring or scratching the surface, or generally by using any technique which destroys the physical integrity of the uppermost layer 23 down to a point into and through the intermediate conductive layer 22. This can be performed for example by the use of a solvent which selectively dissolves the upper layer 23 and the conductive layer 22, thereby providing access to the conductive layer 22. While a conductive adhesive composition by itself can be filled into this slot or hole, it is preferred to use the adhesive-coated foil as shown in FIG. 5, the adhesive being designated 26 and the foil 25.

FIG. 6 shows a related embodiment wherein the slot or hole 30 is only made in the uppermost layer 29 down to but not into the conductive layer 28, which overlies support 27. The adhesive 32 contacts conductive layer 28 at the bottom of the slot 30, and the adhesive 32 is shown in FIG. 6 as being covered by a foil member 31.

The improved technique of the present invention is advantageous compared to methods and techniques taught in the prior art. For example, the technique of the present invention increases the options one has for making contact with an electrode in the apparatus employed in imaging the recording member, in that the location of the hole is not limited to an edge and any non-image area can be chosen, and in addition the front or back of the member can be contacted. Further, the connection of the present invention provides an effective interconnection between the interlayer and the back coat in recording members having a conductive back layer. Further, since the connection is made with an adhesive, it is flexible and durable, especially with the use of the metallic foil. The present invention also makes it unnecessary to remove or render conductive the upper layer in order to establish contact with the intermediate conductive layer.

If a hot-melt or pressure-sensitive adhesive is used, the problems associated with the use of a solvent are avoided as indicated above. If an adhesive-coated foil is employed, this provides a convenient and effective manner of metering and applying the conductive adhesive, as well as providing a low contact resistance connection assuring better and more reproducible image quality. Because of the high conductivity of the foil, it can be used in any desired size or shape. The preferred size is one having a surface area of from about 0.1 $cm.^2$ to about 3 $cm.^2$, and is easily applied in squares or discs. Lastly, if a pressure-sensitive adhesive-coated on foil is employed, it is easy to apply, no heat being necessary, thereby avoiding the risk of thermal damage to the recording member.

The present invention relates specifically to the improved technique for making ground connection to the electrically-conductive intermediate layer of the recording members above described. The invention does not per se reside in the composition, basic structure or other characteristics of the recording member per se. The present invention is expressly applicable to any conventional electrostatographic recording member having at least three layers, a support which is electrically insulating, an electrically conducting layer overlying the support and an uppermost layer which is either photoconductive (in the case of electrophotographic members) or a dielectric material having a high volume resistivity (in the case of an electrographic recording member). An optional fourth layer is the conductive back layer on the opposite side of the support from the intermediate conducting layer and either the photoconductive or dielectric layers.

One skilled in the art can select appropriate materials to form these conventional recording members. Thus, as the support various materials can be used, such as paper or synthetic resins such as polyesters (e.g., polyethylene terephthalate) or cellulose esters (e.g., cellulose acetate) and the like. Preferably, the support is formed of a transparent material such as polyethylene terephthalate or cellulose acetate when the recording member is to be used as a master in a photographic reproduction process where the information imaged thereon is to be exposed from the back side of the recording member. The thickness of the support may vary depending upon the end use, there being no particular limitation as to the thickness of the support.

The intermediate conducting layer which is coated onto the support, evaporated thereon or formed as a part of the upper surface of the support, can comprise literally any conducting composition. Normally, the conducting layer comprises an electrically-conducting material dispersed in a binder therefor and coated onto the support, such as from a solvent solution thereof. The electrically-conducting material may be the same as that used in applicant's adhesives and the binder may be polymeric in nature, such as polyolefins, vinyl polymers such as polyvinyl chloride, acrylates, methacrylates, polyesters, styrene-butadiene copolymers, polyvinyl acetate, polystyrene, polyamides, polycarbonates, copolymers thereof, etc. Illustrative of the electrically-conducting materials which may be employed in such intermediate conducting layers are ionizable polyelectrolyte salts, polymeric quaternary ammonium salts, polystyrene sulfonic acid salts, salts of copolymers of vinyl compounds with maleic acid, Calgon 261, vinyl acetate, and metal coatings deposited by sputtering or vacuum deposition to render the component electrically conducting. The thickness of the conducting layer is not particularly limited, and those skilled in the art can vary the thickness as desired.

In an electrophotographic element, the upper layer is photoconductive and normally comprises an organic or inorganic photoconductor dispersed in a binder therefor. Any organic or inorganic photoconductor is useful in the electrophotograhic elements of the present invention. Typical organic photoconductors include, for example, quinacridones, carboxamides, carboxanilides, triazines, anthraquinones, ano compounds, salts and lakes of compounds derived from 9-phenylxanthane, dioxazines, lakes of fluorescein dyes, pyrenes, phthalocyanines, metal salts and lakes of azo dyes, polyvinyl carbazole, substituted phenylene diamines, and the like. Several substituted phenylene diamines are described in detail in U.S. Pat. Nos. 3,314,788 issued Apr. 18, 1967 to Mattor and 3,615,404 issued Oct. 26, 1971 to Price et al. The amount of the photoconductive material in the photoconductive layer is at least the minimum required to render the layer photoconductive, with the amount generally varying from 5% to 65% by weight, based on the weight of the photoconductive layer. The disclosures of the aforementioned Mattor and Price et al patents are hereby incorporated herein by reference for their disclosures of suitable photoconductive materials.

Also operable in the photoconductive layer, and preferred, are sensitizing compounds which further increase the sensitivity of the photoconductive materials to light of certain wavelengths. Any conventional sensitizing compounds may be employed in the photoconductive layer of the present invention to be used in combination with related photoconductive materials to further increase the sensitization of the photoconductive layer. The amount of the sensitizer in the photoconductive layer can vary within wide ranges, with the optimum concentration in any given case varying with the specific photoconductor employed and the sensitizing compound used. Normally, sensitizers are employed in amounts of from 0.05% to 0.3% by weight, based on the weight of the photoconductive layer, or about 3 ml of a 1% solution of the sensitizer for each 25 grams of photoconductor employed.

The photoconductive layer may be coated onto the electrically-conductive intermediate layer such as from a solvent solution of the composition. The solvent will of course vary depending upon the photoconductor and sensitizer, if one is present, and the binder. Those skilled in the art can certainly practice the present invention using various solvents with a minimum amount of experimentation.

With the electrographic recording elements of the present invention, the support and intermediate electrically-conductive layers would be the sme and can be formed of any of the above described materials. The upper layer is formed of a material having a high volume resistivity, preferably a minimum of $10^{12}$ ohm-centimeters. Typical materials are as follows: styrenebutadiene copolymers; silicone resins; styrene-alkyd resins; silicone alkyd resins; soya-alkyd resins; poly(vinyl chloride); poly(vinylidene chloride); vinylidene chloride-acrylonitrile copolymers; poly(vinyl acetate); vinyl acetate-vinyl chloride copolymers; poly (vinyl acetals), such as poly(vinyl butyral); polyacrylic and methacrylic esters, such as poly(methylmethacrylate), poly(n-butylmethacrylate), poly(isobutyl methacrylate), etc.; polystyrene: nitrated polystyrene; polymethystyrene; isobutylene polymers; polyesters, such as poly(ethylenealkaryloxyalkylene terephthalate); phenol-formaldehyde resins; ketone resins; polyamide; polycarbonates; polythiocarbonates; poly(ethyleneglycol-co-bishydroxyethoxphenyl propane terephthalate); etc. Methods of making resins of this type have been described in the prior art for example, styrene alkyd resins can be prepared according to the method described in U.S. Pat. Nos. 2,361,019 and 2,258,423. Suitable resins of the type contemplated for use in the photoconductive layers of the invention are sold under such trade names as Vitel PE-101, Cymac, Piccopale 100, and Saran F-220 and Lexan 105. Other types of binders which can be used in the photoconductive layers of the invention include such materials as paraffin, mineral waxes, etc.

With regard to the electrically-conductive back layer used in certain embodiments, this can be formed of materials which are similar to or the same as the intermediate electrically-conductive layer. In addition, both of these conductive layers can be formed of electrically-conductive materials per se instead of conductive pigments dispersed in a binder. For example, U.S. Pat. No. 3,011,918 discloses a conductive resinous polymer, polyvinyl benzyl trimethyl ammonium chloride, which is itself conductive. Alternatively, these layers may be made by printing or coating the support surface with an electro-conductive ink, or a metal or a suitable semiconductor may be vacuum deposited or sputtered onto the support. See, for example, U.S. Pat. Nos. 3,207,625; 2,756,165; 3,148,083; 3,245,833; and 3,428,451.

As will be apparent from the above description, the preferred compositions are those which provide a flexible recording member, particularly those materials are preferred which are flexible and transparent to provide a transparent recording member. In addition, it is preferred that the support be substantially electrically insulating in nature.

While the invention has been shown and described with reference to preferred embodiments thereof, it is to be expressly understood that various changes and modifications may be made without departing from the spirit and scope of the present invention, as defined in the appended claims.

What is claimed is:

1. An improved electrostatograhic recording member comprising:
   - an electrically-insulating substrate;
   - an electrically-conductive intermediate layer overlying the upper surface of said substrate;
   - an electrically-insulating outer layer overlying the upper surface of said conductive layer, said outer layer comprising a photoconductive material or a dielectric material of high volume resistivity; and
   - improved means for establishing electrical connection from said conductive layer to a ground, said means comprising:
     - (a) a hole in a non-image area of said recording member, said hole extending from the upper or lower exterior surface of said recording member at least to said conductive layer; and
     - (b) an insert member, said insert member being confined to said non-image area of said recording member, having a maximum resistance of $10^9$ ohm cm and comprising:
       - (1) an electrically conductive adhesive composition disposed in said hole, said conductive adhesive composition comprising an adhesive and a sufficient amount of an electrically-conductive material to make said composition conductive, said conductive adhesive composition being positioned in said hole such that said conductive adhesive composition is in electrical contact with said conductive layer; and
       - (2) a conductive metallic foil, covering and integrally bonded to the outer surface of said conductive adhesive composition disposed in said hole, for reducing the contact resistance between ground and said conductive adhesive composition, said conductive adhesive composition and said metallic foil being confined to said non-image area of said recording member, said conductive adhesive composition providing the sole electrically-conductive path between said conductive layer of said recording member and said metallic foil, said metallic foil being adapted for electrical contact to ground.

2. The improved recording member of claim 1 wherein said recording member further comprises a second electrically-conductive layer, said second conductive layer underlying the lower surface of said substrate, said hole extending from the lower surface of said second conductive layer of said recording member at least to said first conductive layer, said conductive adhesive composition additionally being in electrical contact with said second conductive layer and additionally providing the sole electrically-conductive path between said second conductive layer and said first conductive layer of said recording member.

3. The recording member of claim 1 or 2 wherein said hole extends through the entire thickness of said recording member and said conductive metallic foil covers and is integrally bonded to both the upper and lower outer surfaces of said conductive adhesive composition.

4. The recording member of claim 1 wherein said adhesive comprises a hot-melt adhesive.

5. The recording member of claim 1 wherein said adhesive comprises a pressure-sensitive adhesive.

6. The recording member of claim 1 wherein said hole extends from the upper surface of said electrically-insulating outer layer of said recording member only to said conductive layer.

7. The recording member of claim 1 wherein said hole extends from the upper surface of said electrically-insulating outer layer of said recording member through said conductive layer and into said substrate.

8. A process for preparing an electrostatographic recording member having improved means for establishing an electrical connection between an intermediate conductive layer of said recording member and a ground, said recording member comprising:
   - an electrically-insulating substrate;
   - an electrically-conductive intermediate layer overlying the upper surface of said substrate; and
   - an electrically-insulating outer layer overlying the upper surface of said conductive layer, said outer layer comprising a photoconductive material or a dielectric material of high volume resistivity;

said process comprising:
   - (1) forming a hole in a non-image area of said recording member, said hole extending from the upper or lower exterior surface of said recording member at least to said conductive layer;
   - (2) inserting in said hole an electrically-conductive adhesive composition comprising an adhesive and a sufficient amount of an electrically-conductive material to make said composition electrically-conductive, the outer surface of said conductive adhesive composition in said hole being covered by and integrally bonded to a conductive metallic foil for reducing the contact resistance between ground and said conductive adhesive composition, said metallic foil being adapted for electrical contact to ground, said conductive adhesive composition and said metallic foil being confined to said non-image area of said recording member and together having a maximum total resistance of $10^9$ ohm cm; and
   - (3) bonding said conductive adhesive composition in said hole to said recording member such that said conductive adhesive composition is brought into electrical contact with said conductive layer and provides the sole electrically-conductive path between said conductive layer of said recording member and said metallic foil.

9. The process of claim 8 wherein said hole extends through the entire thickness of said recording member, and wherein both the upper and lower outer surfaces of said conductive adhesive composition are covered by and integrally bonded to said conductive metallic foil.

10. The process of claim 9 wherein two pieces of conductive metallic foil, each coated on one side with said conductive adhesive composition, are applied to the opposite ends of said hole with the coated sides facing each other, and are forced inward so that the coated surfaces meet in the hole, whereby the ends of said hole are covered by said metallic foil.

11. The process of claim 10 wherein said adhesive is a pressure-sensitive adhesive.

12. The process of claim 10 wherein said adhesive is a hot-melt adhesive and said steps (2) and (3) comprise heating said pieces of coated conductive metallic foil and forcing the melted adhesive composition into said hole.

13. The process of claim 8 wherein said hole extends from the upper surface of said electrically-insulating outer layer of said recording member through said conductive layer and into said substrate, and wherein a piece of conductive metallic foil, coated on one side with said conductive adhesive composition, is applied to the end of said hole, with the coated side facing said hole, and said adhesive composition is forced into said hole, whereby the end of said hole in covered by said metallic foil.

* * * * *